US005692484A

United States Patent [19]

Downey

[11] Patent Number: 5,692,484

[45] Date of Patent: Dec. 2, 1997

[54] SYNCHRONIZATION CIRCUIT FOR A COIL-PER-PLUG IGNITION SYSTEM

[75] Inventor: Joel Franklin Downey, Kokomo, Ind.

[73] Assignee: Delco Electronics Corp., Kokomo, Ind.

[21] Appl. No.: 700,885

[22] Filed: Aug. 21, 1996

Related U.S. Application Data

[63] Continuation-in-part of Ser. No. 333,692, Nov. 3, 1994, Pat. No. 5,561,379.

[51] Int. Cl.[6] ..... F02P 3/12

[52] U.S. Cl. ..... 123/643

[58] Field of Search ..... 123/643, 179.5, 123/425, 435, 620, 414; 324/391, 464, 460, 462; 73/35, 115; 177/311; 364/431.04

[56] References Cited

U.S. PATENT DOCUMENTS

| | | | |
|---|---|---|---|
| 2,517,976 | 8/1950 | Clarke | 177/311 |
| 2,523,017 | 9/1950 | Harrison | 177/311 |
| 2,560,734 | 7/1951 | Mouzon | 175/183 |
| 4,648,367 | 3/1987 | Gillbrand et al. | 123/425 |
| 5,186,144 | 2/1993 | Fukui | 123/414 |
| 5,228,425 | 7/1993 | Simons | 123/620 |
| 5,317,267 | 5/1994 | Miyata et al. | 324/402 |
| 5,376,886 | 12/1994 | Shimasaki et al. | 324/402 |
| 5,447,136 | 9/1995 | Hartmann et al. | 123/425 |
| 5,493,496 | 2/1996 | James et al. | 364/431.04 |

*Primary Examiner*—Raymond A. Nelli
*Attorney, Agent, or Firm*—Mark A. Navarre

[57] ABSTRACT

A circuit for providing a synchronizing signal based on detected ignition voltages in a coil-per-plug ignition system. In this type of ignition system, each spark plug has its own step-up transformer, typically packaged in close proximity to the spark plug itself. Normally, the plugs are fired individually to extend plug life, but according to this invention, at least two of the plugs are fired concurrently during engine cranking. During such operation, the circuit senses the voltages at the primary transformer windings of two different spark plugs to identify the respective spark plug firings, and the synchronizing signal is produced based on the sequence of the identified firings.

4 Claims, 4 Drawing Sheets

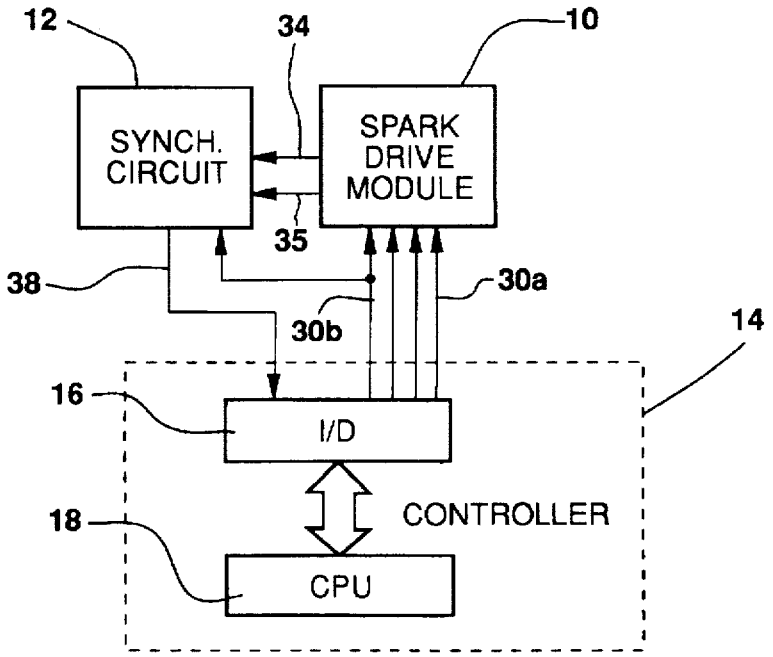
FIG - 1
FIG - 2
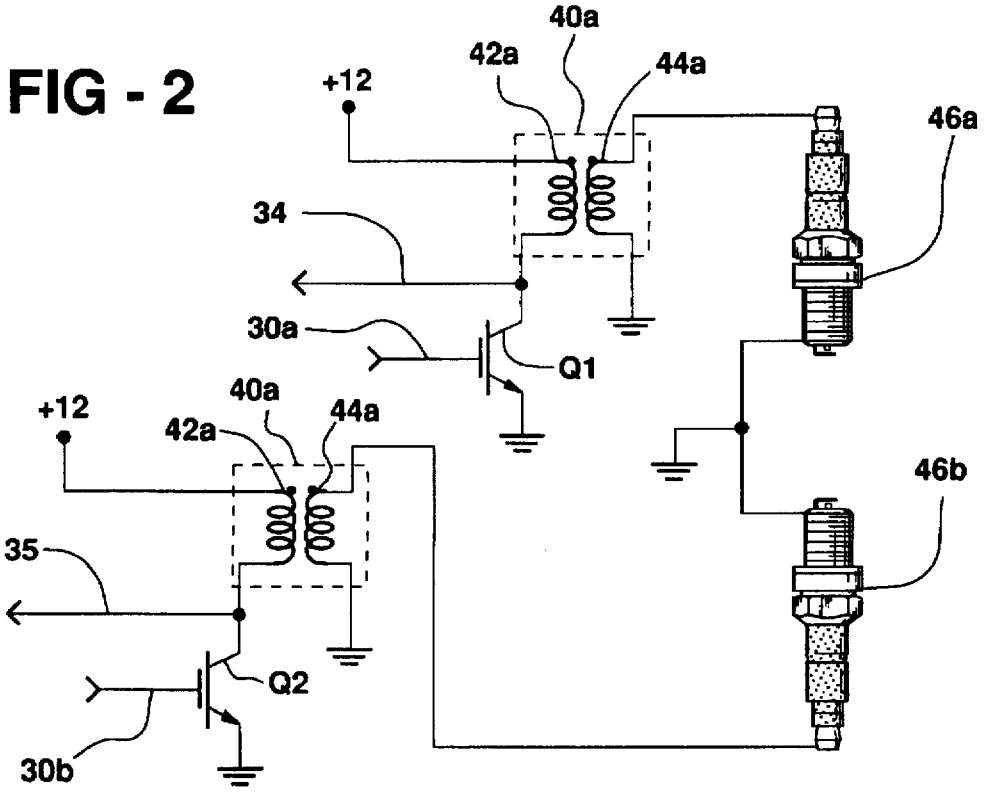

FLIP FLOP
D
R
Q
Q'
CLK
90
88
ONE SHOT
T1
T2
A
B
RST
92
80
82
84
86
70
72
74
76
78
38
35
34
30a
C-4
C-1
J1
J2
+5
+12
R1
R2
R3
R4
R5
R6
R7
R8
R9
R10
R11
R14
R15
R16
R17
R18
R19
R21
R22
R23
R24
R25
R26
R28
R37
R38
C1
C2
C3
C4
C5
C6
C7
C8
C9
C14
D1
D2
D3
D4
Q6
Q8

SYNCHRONIZATION CIRCUIT FOR A COIL-PER-PLUG IGNITION SYSTEM

This is a continuation-in-part of U.S. Ser. No. 08/333,692, filed Nov. 3, 1994, now U.S. Pat. No. 5,561,379.

BACKGROUND OF THE INVENTION

Engine ignition systems in general require a signal which provides absolute engine position in order to properly control the sequence and timing of the firing of the spark plugs. The signal is typically generated as a relative position signal, and then synchronized with a signal generated by an auxiliary position sensor in order to provide the required absolute position information.

SUMMARY OF THE PRESENT INVENTION

The present invention is directed to a circuit for providing an ignition system synchronization signal based on detected ignition voltages, particularly in a coil-per-plug ignition system. In this type of ignition system, each cylinder has its own step-up transformer, typically packaged in close proximity to the respective spark plug. In the engine-run mode, the plugs are fired individually to extend plug life, but in an engine-cranking mode preceding the run mode, at least two spark plugs of opposing crank cycle (compression and exhaust) are fired concurrently. During the engine-cranking mode, the circuit identifies the compression stroke cylinder based on discharge-related voltages at the primary transformer windings of the two spark plugs, and produces a synchronization signal for synchronizing individual spark firing in the ensuing engine-run mode.

BRIEF DESCRIPTION OF THE DRAWINGS

FIG. 1 is a block diagram of a coil-per-plug ignition system including a spark drive module, a synchronization circuit and a controller.

FIG. 2 is a circuit diagram of the spark drive module of FIG. 1.

DETAILED DESCRIPTION OF THE DRAWINGS

Figure 3A:
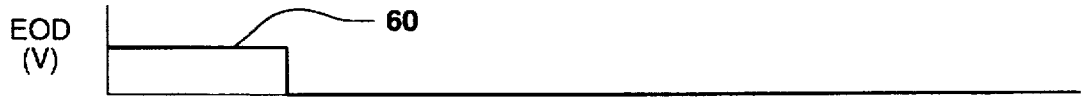
FIGS. 3A–3F are time-based graphs depicting representative ignition signals generated by the ignition system and the synchronization circuit of FIG. 1.

Referring to FIG. 1, a controller 14, which may be a conventional single chip microcontroller having input/output means I/O 16 and central processing unit CPU 18, electrically communicates a spark command to spark drive module 10 and to synchronization circuit 12 via control lines 30*a*–30*d*. The spark drive module 10 is part of a coil-per-plug ignition system in which each spark plug has its own individually controlled step-up transformer, as will be described in reference to FIG. 2. The illustrated embodiment depicts a four-cylinder engine having four spark plugs, and hence, four control lines 30*a*–30*d*.

The spark drive module 10 provides ignition voltage output signals from two different cylinders to synchronization circuit 12 via lines 34 and 35. The output signals are interpreted by the circuit 12 to form an synchronization signal on line 38 back to controller 14 indicating the occurrence of cylinder events, such as the occurrence of a combustion event in a predetermined cylinder. Circuit 12 is detailed in FIG. 4, to be described. The synchronization signal on line 38 may be used by controller 14 in a determination of absolute engine position by relating the detected event to an absolute engine angle in an engine operating cycle. In a manner generally understood in the art of engine control and diagnostics, the synchronization signal may be used to synchronize relative engine position signals, such as signals from an engine crankshaft position sensor (not shown).

The spark drive module 10 is schematically depicted in part in FIG. 2, wherein each of two spark plugs 46*a* and 46*b* are coupled to individually controllable step-up transformers 40*a* and 40*b*, respectively. Each transformer includes a primary coil 42*a*, 42*b* and a secondary coil 44*a*, 44*b*. The primary coils 42*a*, 42*b* are individually driven by insulated-gate bi-polar transistors (IGBTs) Q1 and Q2, which in turn are controlled by spark commands on lines 30*a* and 30*b*, respectively. The high side of each primary coil 42*a*, 42*b* is connected to a supply voltage, set at approximately twelve volts from a twelve volt battery (not shown) in this embodiment, such that when spark commands on lines 30*a* and 30*b* are high, as illustrated by the signal 60 in FIG. 3A, IGBTs Q1 and Q2 will conduct, directing current through the primary coils 42*a* and 42*b*.

When the spark commands on lines 30*a* and 30*b* drop low, the collapsing magnetic fields caused by the interrupted current in the primary coils 42*a* and 42*b* drive up the voltage across the respective secondary coils 44*a* and 44*b*. The secondary voltage will continue to rise until reaching the breakdown voltage across the gaps of the respective spark plugs 46*a* and 46*b*. Current will discharge across the gap of the spark plugs 46*a* or 46*b* when their respective breakdown voltage is reached, as is generally understood in the art.

Spark plug 46*a* is disposed in a first cylinder, such as cylinder number one, and spark plug 46*b* is disposed in a second cylinder of opposing crank cycle, such as cylinder number four of a four cylinder internal combustion engine (not shown). According to this invention, the primary windings 42*a* and 42*b* are concurrently controlled, at least during an engine-cranking mode, so that the plugs 46*a* and 46*b* are fired more or less at the same time. In other words, the trailing edges of the command signals 30*a* and 30*b* occur substantially at the same time. At such point, one of the corresponding cylinders (say, cylinder number one) will be in its compression stroke at high pressure and the other cylinder (cylinder number four) will be in a lower pressure stroke, such as the exhaust stroke with its exhaust valves open.

It is generally understood by those skilled in the art of ignition control that a relationship of direct proportionality exists between cylinder pressure magnitude and the magnitude of the breakdown voltage across a given spark plug gap. Thus, the spark plug in a compression-cycle cylinder requires a significantly higher voltage across its gap for breakdown than does a spark plug in an exhaust-cycle cylinder. As the two primary windings operate from a common 12-volt source, the spark plug in the high pressure cylinder will require more time to reach its breakdown voltage than will the plug in the lower pressure cylinder. A factor in the magnitude of this time difference is the amount of capacitance in the drive circuitry including the windings, cables and spark plugs, as this capacitance reduces the rate at which voltage from the secondary charges up across each of the spark plugs 46*a* and 46*b*.

Experimentation has demonstrated that this time difference between breakdown of the pair of plugs is measurable.

Accordingly, analysis of the time relationship of the discharge ignition voltage across the spark plugs provides direct information on which plug and thus which cylinder is in its compression, or alternately, its exhaust stroke. This information may be used to synchronize a relative engine position signal, thereby providing a signal that indicates the absolute angular position of the engine.

Figure 3B:
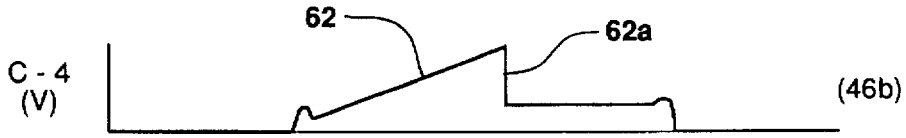
Figure 3C:
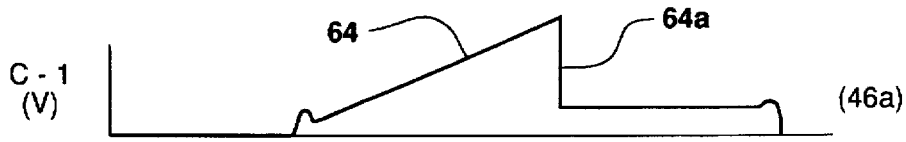

FIGS. 3A–3F depict representative time-related signals for the spark drive module of FIG. 2, assuming that the spark plug 46b fires during an exhaust stroke, while the spark plug 46a fires during a compression stroke. A spark plug firing during an exhaust stroke may be referred to as a waste spark, while a spark plug firing during a compression stroke may be referred to as a non-waste spark. Signal 60 represents a command signal such as would be present on lines 30a and 30b during engine cranking. Signal 62 of FIG. 3B illustrates the primary winding voltage for cylinder number four (exhaust stroke) on output line 35, and signal 64 of FIG. 3C illustrates the primary winding voltage for cylinder number one (compression stroke) on output line 34. In each case, the primary winding signals comprise an initial transient at the trailing edge of the command signal 60 due to stray inductance in the primary circuits, followed by a voltage waveform reflected by transformer action from the respective secondary windings. Thus, the signals 62 and 64 increase in magnitude substantially contemporaneously as seen in FIGS. 3B–3C until the respective breakdown voltages of spark plugs 46b and 46a are reached, as indicated at 64a and 62a, respectively. The spark plug 46b associated with cylinder number four (exhaust stroke) reaches its relatively low breakdown voltage more quickly due to the relatively low cylinder pressure, while the spark plug 46a associated with cylinder number one (compression stroke) requires significantly more time to reach its breakdown voltage due to the relatively high cylinder pressure.

Figure 4:
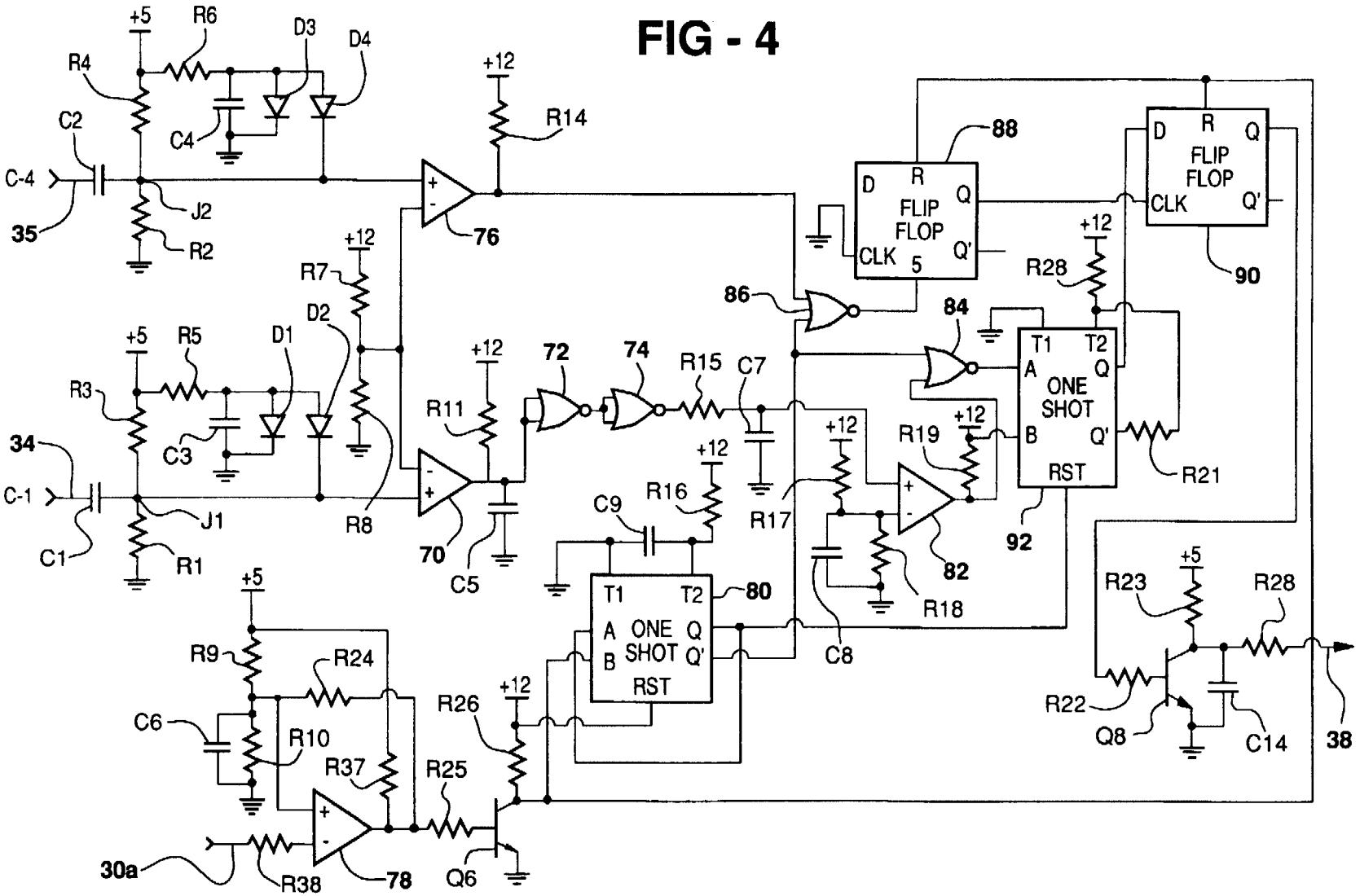
FIG. 4 is a circuit diagram of the synchronization circuit of FIG. 1.

In general, the circuit of FIG. 4 diagnoses the non-waste spark in cylinder one by determining if the transient designated by reference numeral 62a occurs before the transient designated by the reference numeral 64a. When a non-waste spark is detected in cylinder one, the circuit of FIG. 4 outputs a falling edge signal on line 38, as designated by reference numeral 38a in FIG. 3F. The falling edge is received by controller 14, such as by a conventional input capture port in input/output I/O unit 16, and the time of the falling edge is used to synchronize a relative position signal such as from a crankshaft position sensor (not shown).

The specific interconnection of the elements that make up the synchronization circuit 12 are illustrated in FIG. 4. The signal on line 34 is passed through a high-pass filter comprising capacitor C1 and resistor R1, producing a discharge signal at junction J1 as graphically depicted in FIG. 3E. Similarly, the signal on line 35 is passed through a high-pass filter comprising capacitor C2 and resistor R2, producing a discharge signal at junction J2 as graphically depicted in FIG. 3D. The resistors R3 and R4 cooperate with resistors R1 and R2, respectively, to increase the bias point of the discharge signals to approximately 2.5 volts. A clamping circuit including resistor R5, capacitor C3, and diodes D1 and D2 is connected to the discharge signal at junction J1 to clamp negative transients. A similar clamping circuit including resistor R6, capacitor C4, and diodes D3 and D4 is connected to the discharge signal at junction J2.

The bias adjusted and clamped discharge signals are coupled to the non-inverting inputs of comparators 70 and 76. The inverting inputs of comparators 70 and 76 are fixed at reference voltage of approximately 1.0 volt set by a voltage divider comprising resistors R7 and R8. Pull-up resistors R11 and R14 normally bias the comparator outputs to a high or logic-one voltage level.

Figure 3D:
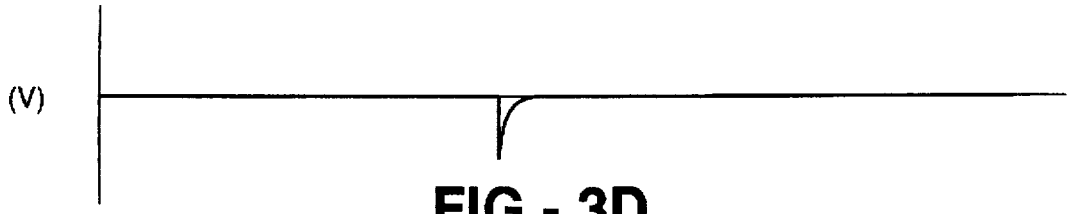
Figure 3E:
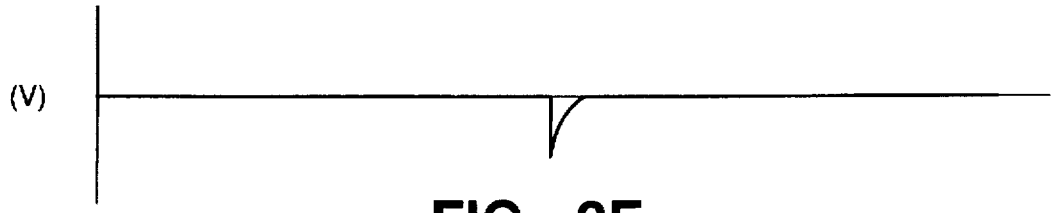
Figure 3F:
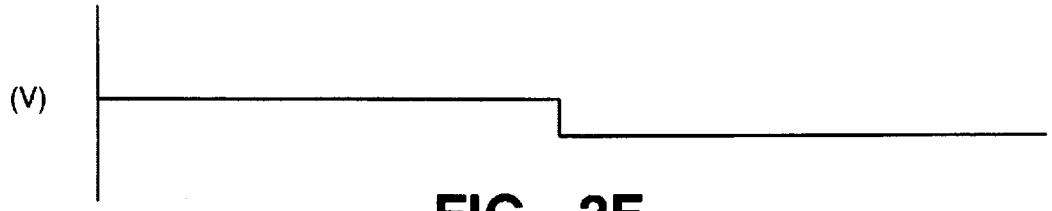

Accordingly, the output of comparator 70 will be biased high, and will remain high until a discharge transient (such as depicted by the reference numeral 64a in FIG. 3C) on line 34 produces a negative-going pulse (as depicted in FIG. 3E) at junction J1. Similarly, the output of comparator 76 will be biased high, and will remain high until a discharge transient (such as depicted by the reference numeral 62a in FIG. 3B) on line 35 produces a negative-going pulse (as depicted in FIG. 3D) at junction J2. The respective comparator outputs will remain low until the respective spark plug transients have passed, approximately 0.5 microseconds, and then will return high.

The output of comparator 76 is supplied as an input to two-input NOR gate 86, discussed below. The output of comparator 70 is passed through pulse extending circuitry, including resistor R11 and capacitor C5, so that when output of comparator 70 switches from low to high states, the signal out of the pulse stretching circuitry will rise at an exponential rate as C5 charges up to the high level. This delayed rising edge is passed successively through NOR gates 72 and 74, connected in series as signal level inverters.

The output of the NOR gates 72 and 74 is a squared version of the pulse stretching circuitry output having a rising edge delayed by the amount of time required for the exponential voltage rise from the pulse stretching circuitry to cross the threshold of the NOR gate 72. In this embodiment, the rising edge of the signal is delayed through the NOR gates by approximately fifteen microseconds from the time of the rising edge of comparator 70. Of course, the falling edge of the signal out of comparator 70 is not delayed by the pulse stretching circuitry or by the NOR gates.

Output of NOR gate 74 is passed through a first order filter including resistor R15 and capacitor C7, having a time constant of approximately one microsecond, to delay the edges of the NOR gate 74 output. The filter output is passed to the non-inverting input of comparator 82. The inverting input of comparator 82 is connected to a predetermined threshold voltage of approximately 4.4 volts, or the supply voltage of approximately twelve volts divided by the constant e, which is generally known to be about 2.7. This voltage setting is provided via a conventional voltage divider including resistors R17 and R18, and a voltage supply signal of approximately twelve volts.

Transitions at the output of NOR gate 74 will thus be delayed by one time constant of the filter formed by R15 and C7 before appearing at the output of comparator 82. Sensitivity of this delay to variations in supply voltage is decreased by dividing down the supply voltage via this divider circuit at the inverting input to comparator 82. Conventional filtering on the signal through the divider circuitry is provided by capacitor C8. Comparator 82 output is high when the output of NOR gate 74, delayed by the first order filter, exceeds approximately 4.4 volts, and comparator output is low otherwise.

In this embodiment, comparator 82 output is thus a delayed version of the detected negative going discharge transient at junction J1, with a delay of approximately 1.5 microseconds, one microsecond of which is provided by the first order filter including R15 and C7, and the other 0.5 microseconds of which is due to circuit propagation delays. Comparator 82 output is pulled up through resistor R19 and passed as an input to two-input NOR gate 84.

The second input to both NOR gates 84 and 86 is an output Q' from conventional one-shot 80. Generally, this one-shot fires for approximately 100 microseconds after the falling edge of the spark command, such as the falling edge of the signal 60 in FIG. 3A, which starts the charge-up of the voltage across the gap of spark plugs 46*a* and 46*b*, as described. The one-shot firing thus provides approximately a 100 microsecond window in which to analyze the ignition transient, as will be described.

Specifically, the spark command on line 30*a* (or 30*b*, if desired) is input to the inverting input of comparator 78 through resistor R38. Resistor R38 is provided to limit loading on the spark command line. A voltage level is provided to the non-inverting input of comparator 78 via a voltage divider including resistor R9 and resistor R10. Comparator input filtering is provided by capacitor C6. The voltage level at the non-inverting input to comparator 78 is set to the spark command threshold level, below the voltage level on line 30*a* during ignition dwell periods and above the voltage level on line 30*a* during non-dwell periods.

Conventional comparator threshold hysteresis is provided in this embodiment by connecting resistor R24 between the comparator output and its non-inverting input. As such, the comparator 78 output will be low when the spark command input from line 30*a* exceeds approximately 2.3 volts, but will not be driven high unless the input from line 30*a* drops below approximately 1.3 volts, which generally decreases the sensitivity of comparator 78 to input noise.

The output of comparator 78 is high when the spark command is low, and the output is low during the ignition dwell period, when the spark command is high. The comparator output is pulled up via resistor R37, and is passed through resistor R25 to inverting transistor Q6. The collector of transistor Q6 is pulled up to supply voltage of twelve volts via resistor R26, and is passed to the reset input R of conventional D-type flip-flop 90, to be described, to the reset input R of conventional D-type flip-flop 88, to be described, and to input B of one-shot 80.

The conventional one-shot 80 provides a window around the ignition events of interest, during which time analysis and temporal comparison of the discharge transients from the pair of spark plugs 46*a* and 46*b* may be made. Specifically, when the spark command line 30*a* drives the input B to the one-shot 80 low, which is at the end of the dwell period when the voltage across the gap of the two spark plugs 46*a* and 46*b* starts to charge up to the respective breakdown voltages, the one-shot output Q is driven high, and the inverted one-shot output Q' goes low. The output Q' is provided to NOR gates 84 and 86, gating the other input to the NOR gates through to the respective NOR gate outputs. This gating continues for the period of the one-shot 80, set at approximately 100 microseconds in this embodiment by capacitor C9 and resistor R16.

During this active period of one-shot 80, the output of comparator 76 is gated as a set input S to D-type flip-flop 88. The output Q of flip-flop 88 is provided as a clock input CLK to D-type flip-flop 90, wherein CLK is active on a rising edge. Accordingly, in a critical part of this embodiment of the invention, during the period of one-shot 80, the state of the input D to flip-flop 90 will be gated through to its output Q when the output of comparator 76 switches from high to low, which is at the approximate time a discharge transient is detected at junction J2.

During this active period of one-shot 80, the output of comparator 82 is gated through as input A to one-shot 92. The other input B to one-shot 92 is active low, and is disabled by connecting it to a positive voltage source, such as a twelve volt source. The output Q of one-shot 92 is connected as the data input D to flip-flop 90. One-shot 92 is connected in a configuration wherein it functions as a conventional set-reset flip-flop, where the active high set input is A, the active low set input is B which is disabled in this embodiment, the reset input is the one-shot reset input RST, timer input T1 is grounded, timer input T2 is pulled up through resistor R20, and the inverted output Q' is tied to T2 through resistor R21.

Functionally, output Q of one-shot 92 will be driven high when the output of comparator 82 is driven low during the 100 microsecond window period of one-shot 80. The output Q of one-shot 92 will return low at the end of the window period, when the output Q of one-shot 80 drops low, activating the active low one-shot reset RST input. The outputs of NOR gates 86 and 84 will also drop low at the end of the window period, blocking propagation of discharge transients to the output of the NOR gates.

Therefore, the data input D to flip-flop 90 will remain low until approximately 1.5 microseconds after a discharge transient is detected at junction J1, (cylinder number one). The output Q of flip-flop 90 will thus be high if the discharge transient at junction J1 occurs over 1.5 microseconds before the discharge transient at junction J2 (cylinder number four). Such a temporal relationship between the discharge transients at junctions J1 and J2 would indicate that cylinder one is in its exhaust stroke and cylinder four is in its compression stroke, as described.

Alternatively, the output of flip-flop 90 will be low if ignition in cylinder one occurs within 1.5 microseconds of ignition in cylinder four, or after ignition in cylinder four. The output Q of flip-flop 90 will be reset to zero at the start of the next dwell period, as its reset pin R will be activated by the high output of transistor Q6. The high output of Q6 will also reset flip-flop 88 via its reset input R.

A high output Q of flip flop 90 will be used for synchronization in controller 14 and a low output will be ignored by the controller. The time offset between the transients provided by the circuit of FIG. 4, wherein the cylinder number one transient is delayed by approximately 1.5 microseconds before being compared to the time of the cylinder number four transient, compensates for expected time variations between the detected ignition events in the two cylinders under analysis, such as cylinders one and four in this embodiment. The time relationship between the two events may not, unless compensated, be easily distinguished, for example, when the events occur substantially at the same time, or when the waste spark event occurs after the non-waste event. In some applications, there are engine operating ranges wherein the waste spark event may occur a very short period of time after the non-waste event. The relative pressure in the two cylinders under analysis at the time of ignition, the secondary capacitance of the circuit of FIG. 2, and the engine operating point at the time of ignition all affect this time relationship between spark events. Analysis of the time relationship between the two ignition events for the specific application should be made to determine the extent of such timing variations. The delay imposed between the two signals before they are compared should then be set slightly larger in magnitude than the expected amount of time by which the waste spark signal could occur after the non-waste signal, such as the 1.5 microseconds of the present embodiment.

By setting an appropriate delay as described, the circuit of FIG. 4 will only generate synchronization information when ignition in the compression cylinder clearly lags ignition in the exhausting cylinder. Such information reliably indicates engine absolute position despite the expected minor variations in the temporal relationship between the transients. In other embodiments of this invention, the delay may be adjusted, or eliminated entirely.

Returning to flip-flop 90, the output Q is provided to the base of inverting transistor Q8 through resistor R22. The collector of Q8 is pulled up to five volts through resistor R23, and the emitter is tied to ground. The output of transistor Q8 is filtered via capacitor C14, and buffered via resistor R28 to output line 38, which is connected to controller 14 (FIG. 1), as described. The time of the occurrence of a falling edge of the synchronization signal on line 38 is interpreted by controller 14 as the time of a compression stroke in a predetermined cylinder, such as cylinder one in this embodiment, or equivalently, as the time of the exhaust stroke in a predetermined cylinder, such as cylinder four in this embodiment.

After the falling edge of the synchronization signal is obtained, the controller 14 changes from the engine-crank mode to the engine-run mode, individually firing the various spark plugs, using the synchronization signal to synchronize a relative engine position signal, as generally described above. This mode switching occurs at each engine ignition cycle, with the controller 14 operating in the engine-crank mode until the synchronization signal is established.

Figure 5:
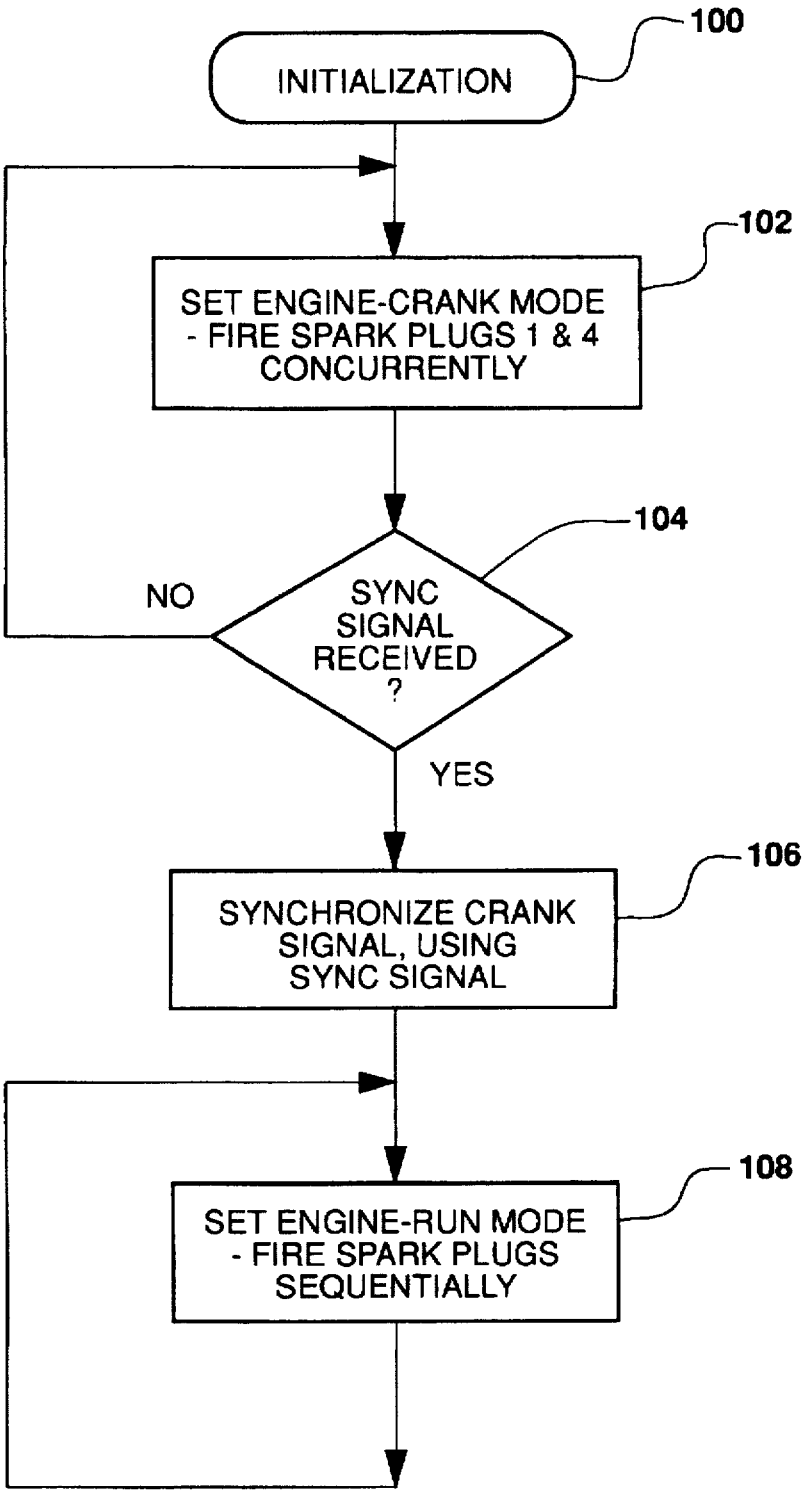
FIG. 5 is a flow diagram depicting the ignition-related operation of the controller of FIG. 1.

The operation of the controller 14 for the illustrated embodiment is generally described by the flow diagram of FIG. 5. Upon closure of the ignition switch (not shown), the controller 14 executes a series of initialization instructions as designated by block 100 for initializing various timers and registers in preparation for engine cranking. At block 102, the engine-crank mode is set, and the spark plugs 46*a* and 46*b* are fired concurrently by driving the control signals 30*a*–30*b* high and low in unison. This can be achieved with timer registers to avoid throughput delays. At decision block 104, the controller 14 determines if a high-to-low transition of the synchronization signal on line 38 has occurred. If not, the mode of block 102 is continued; if so, blocks 106 and 108 are executed to synchronize the relative engine position signal (from a crankshaft sensor, not shown), and to set the engine-run mode, initiating individual firing of the various spark plugs via lines 30*a*–30*d*. The function defined by block 108 is then repeated continuously during the ignition cycle, and the output of synchronization circuit 12 is ignored until the next ignition cycle.

As a practical matter, the lack of a high-to-low transition of the synchronization signal provides just as much information as the occurrence of a high-to-low transition. For example, the controller may initially assume that cylinder number one will be in the compression cycle and that cylinder number four will be in the exhaust cycle when the spark plugs are concurrently fired. A high-to-low transition of the synchronization signal after the spark plugs are commanded to fire will confirm that the assumption was correct, while no transition of the synchronization signal will reveal that cylinder number four was actually in the compression cycle and that cylinder number one was in the exhaust cycle. Thus, the provision or occurrence of a synchronization signal, as used herein, broadly encompasses whatever information is conveyed by the synchronization signal in a time interval after the spark plugs are commanded to fire.

While this invention has been described in reference to the illustrated embodiment, it will be understood that various modifications may occur to those skilled in the art. For example, the timing functions of synchronization circuit 12 could be carried out in software by the controller 14, if desired. Additionally, it would be possible with certain engines to fire the plugs sequentially during the crank mode, in both compression and exhaust cycles, and to obtain the synchronization signal by timing and comparing the discharge intervals for two opposing cycle cylinders. These and other modifications may fall within the scope of this invention, which is defined by the appended claims.

The embodiments of the invention in which a property or privilege is claimed are described as follows.

I claim:

1. Control apparatus for a coil-per-plug ignition system of a multiple cylinder four cycle internal combustion engine, including an individual transformer and spark plug associated with each engine cylinder, each such transformer having a primary winding connected to a voltage source and a secondary winding connected to a respective spark plug, said control apparatus comprising:

controller means for selectively interrupting current in said primary windings of said individual transformers to selectively fire said individual spark plugs, said controller being effective during an engine-cranking mode to fire two spark plugs substantially in unison when one of the cylinders associated with said two spark plugs is in a compression cycle and the other is in an exhaust cycle, and upon receipt of a synchronization signal, to switch from said engine-cranking mode to an engine-run mode in which said spark plugs are fired individually in sequence as a function of said synchronization signal such that the firing of any spark plug occurs only in a compression cycle of the associated cylinder;

synchronization circuitry including voltage sensing means connected to the primary windings of two transformers associated with said two spark plugs, effective during said crank mode to detect firing of said two spark plugs and to produce a synchronization signal based on the order of such detected firing, such signal indicating which of the cylinders associated with such two spark plugs is in a compression cycle; and means for applying said synchronization signal to said controller means, whereupon said controller means switches from said engine-cranking mode to said engine-run mode.

2. The control apparatus of claim 1, wherein said synchronization circuit detects a respective spark plug firing as a voltage transient inductively coupled to said primary winding from the secondary winding of an associated transformer upon the firing of said spark plug.

3. Control apparatus for a coil-per-plug ignition system of a multiple cylinder four cycle internal combustion engine, including an individual transformer and spark plug associated with each engine cylinder, each such transformer having a primary winding connected to a voltage source and a secondary winding connected to its respective spark plug, said control apparatus comprising:

controller means for selectively interrupting current in said primary windings of said individual transformers to selectively fire said individual spark plugs, said controller being effective during an engine-cranking mode to individually fire two spark plugs associated with opposing cycle cylinders in both compression and exhaust cycles of such cylinders, and upon receipt of a synchronization signal, to switch from said engine-cranking mode to an engine-run mode in which said spark plugs are fired as a function of said synchronization signal only in compression cycles of said engine cylinders;

synchronization circuitry including voltage sensing means connected to the primary windings of two of said transformers associated with opposing cycle cylinders, effective during said crank mode to detect the respective spark plug firings and to produce a synchronization signal based on the relative time of firing of such spark plugs, such signal indicating which of said cylinders is in a compression cycle; and means for applying said synchronization signal to said controller means, whereupon said controller switches from said engine-cranking mode to said engine-run mode.

4. The control apparatus of claim 3, wherein said synchronization circuit detects a respective spark plug firing as a voltage transient inductively coupled to the primary winding from the secondary winding of an associated transformer upon the firing of said spark plug.

* * * * *